US009376777B2

(12) United States Patent
Peterson

(10) Patent No.: US 9,376,777 B2
(45) Date of Patent: Jun. 28, 2016

(54) INFLATABLE WATER WALKWAY

(75) Inventor: Leroy L. Peterson, Omaha, NE (US)

(73) Assignee: SDS Asia Limited, BVI #1748971, Central Hong Kong (HK)

( * ) Notice: Subject to any disclaimer, the term of this patent is extended or adjusted under 35 U.S.C. 154(b) by 201 days.

(21) Appl. No.: 13/407,874

(22) Filed: Feb. 29, 2012

(65) Prior Publication Data

US 2013/0225018 A1 Aug. 29, 2013

(51) Int. Cl.

| | |
|---|---|
| ***B63B 35/00*** | (2006.01) |
| ***E01D 15/20*** | (2006.01) |
| *B63B 35/58* | (2006.01) |
| *B63C 9/04* | (2006.01) |
| *B63B 35/34* | (2006.01) |

(52) U.S. Cl.

CPC ..... *E01D 15/20* (2013.01); *B63B 35/34* (2013.01); *B63B 35/58* (2013.01); *B63C 2009/042* (2013.01)

(58) Field of Classification Search

CPC ..... A63B 21/4037; A63B 6/00; A63B 6/02; A63B 2225/62; A63B 2225/60; A61G 7/05769; A47C 27/081; B63C 2009/042; B63C 1/02; B63B 35/58

USPC ..... 441/40, 41, 263

See application file for complete search history.

(56) References Cited

U.S. PATENT DOCUMENTS

| | | | | |
|---|---|---|---|---|
| 1,733,034 | A * | 10/1929 | Tufenkjian | 5/710 |
| 2,850,252 | A * | 9/1958 | Ford | 244/114 R |
| 6,582,264 | B2 * | 6/2003 | Brown | 441/40 |
| 7,178,483 | B2 * | 2/2007 | Wu | 119/498 |
| 7,462,142 | B1 * | 12/2008 | Gordon | 482/142 |
| 2007/0094805 | A1 * | 5/2007 | Davis | A61G 7/05769 5/706 |

* cited by examiner

*Primary Examiner* — Andrew Polay

(74) *Attorney, Agent, or Firm* — Suiter Swantz pc llo

(57) ABSTRACT

An inflatable device is disclosed. The inflatable device includes an airtight inflatable mat. The airtight inflatable mat has a first surface member, a second surface member and at least one side member. A plurality of support structures is substantially evenly disposed internally within the airtight inflatable mat. Each support structure is generally parallel to each other and is coupled to the first surface member and the second surface member of the airtight inflatable mat. Furthermore, a plurality of fastening mechanisms is disposed on the at least one side member of the airtight inflatable mat. The fastening mechanisms are positioned on a plane substantially centrally located between the first surface member and the second surface member, and each fastening mechanism is configured for removably connecting with another fastening mechanism disposed on a side member of another airtight inflatable mat.

9 Claims, 16 Drawing Sheets

INFLATABLE WATER WALKWAY

TECHNICAL FIELD

The disclosure generally relates to the field of inflatable devices, particularly to an inflatable water walkway.

BACKGROUND

Various types of recreational aquatic activities have long been popular with children and adults alike. Floatation devices such as floating tubes/beds and the like have been utilized in some of these activities. Some of these floatation devices may be inflatable. For example, an inflatable floating bed may form an air mattress that floats on water, allowing one or two people to lie on the air mattress and relax.

However, existing floating beds are limited by its size and usefulness that they provide. Therein lies a need for an inflatable device without these shortcomings.

SUMMARY

The present disclosure is directed to an inflatable device. The inflatable device includes a generally rectangular airtight inflatable mat. The airtight inflatable mat has a first surface member, a second surface member, two elongated sides and two short sides. A plurality of support structures is disposed internally within the airtight inflatable mat. Each support structure is generally parallel to the two short sides and is coupled to the first surface member and the second surface member of the airtight inflatable mat. The support structures are disposed substantially evenly in between the two short sides of the airtight inflatable mat, and the distance between two adjacent support structures is less than approximately 3 inches. Furthermore, a pair of fastening mechanisms is respectively disposed on the two short sides of the airtight inflatable mat. The fastening mechanisms are positioned on a plane substantially centrally located between the first surface member and the second surface member, and each fastening mechanism is configured for removably connecting with another fastening mechanism disposed on a short side of another airtight inflatable mat.

A further embodiment of the present disclosure is also directed to an inflatable device. The inflatable device includes an airtight inflatable mat. The airtight inflatable mat has a first surface member, a second surface member and at least one side member. A plurality of support structures is substantially evenly disposed internally within the airtight inflatable mat. Each support structure is generally parallel to each other and is coupled to the first surface member and the second surface member of the airtight inflatable mat. Furthermore, a plurality of fastening mechanisms is disposed on the at least one side member of the airtight inflatable mat. The fastening mechanisms are positioned on a plane substantially centrally located between the first surface member and the second surface member, and each fastening mechanism is configured for removably connecting with another fastening mechanism disposed on a side member of another airtight inflatable mat.

An additional embodiment of the present disclosure is also directed to an inflatable device. The inflatable device includes two airtight inflatable mats. Each airtight inflatable mat has a first surface member, a second surface member and at least one side member. A plurality of support structures is substantially evenly disposed internally within each airtight inflatable mat. The support structures are generally parallel to each other and are coupled to the first surface member and the second surface member of their respective airtight inflatable mat. Furthermore, a pair of fastening mechanisms are respectively disposed on the at least one side member of the each airtight inflatable mat. The fastening mechanisms are configured for removably connecting the first and second airtight inflatable mat to form a floatable walkway.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
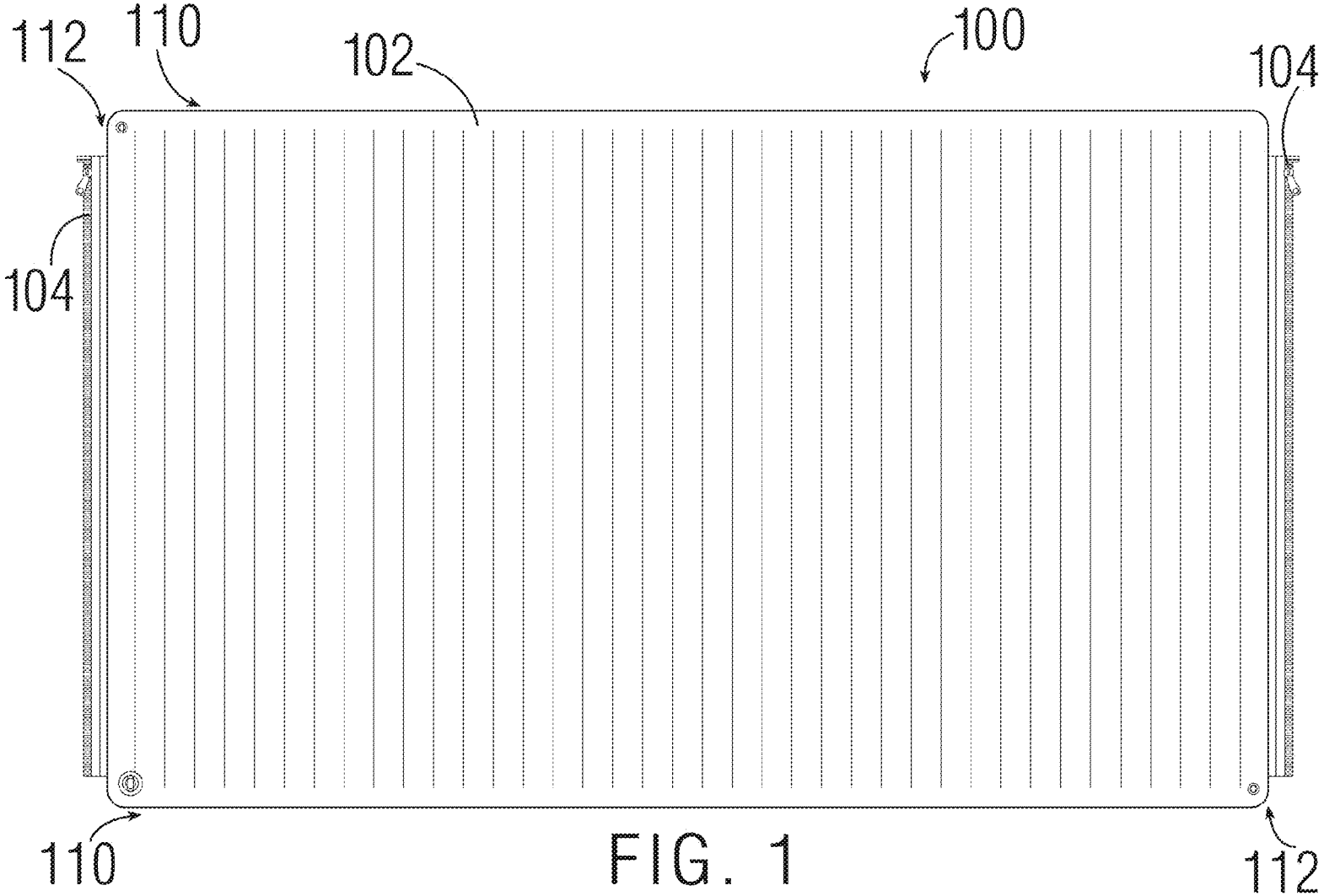
FIG. 1 is a top view of an inflatable mat having a pair of fastening mechanisms.
Figure 2:
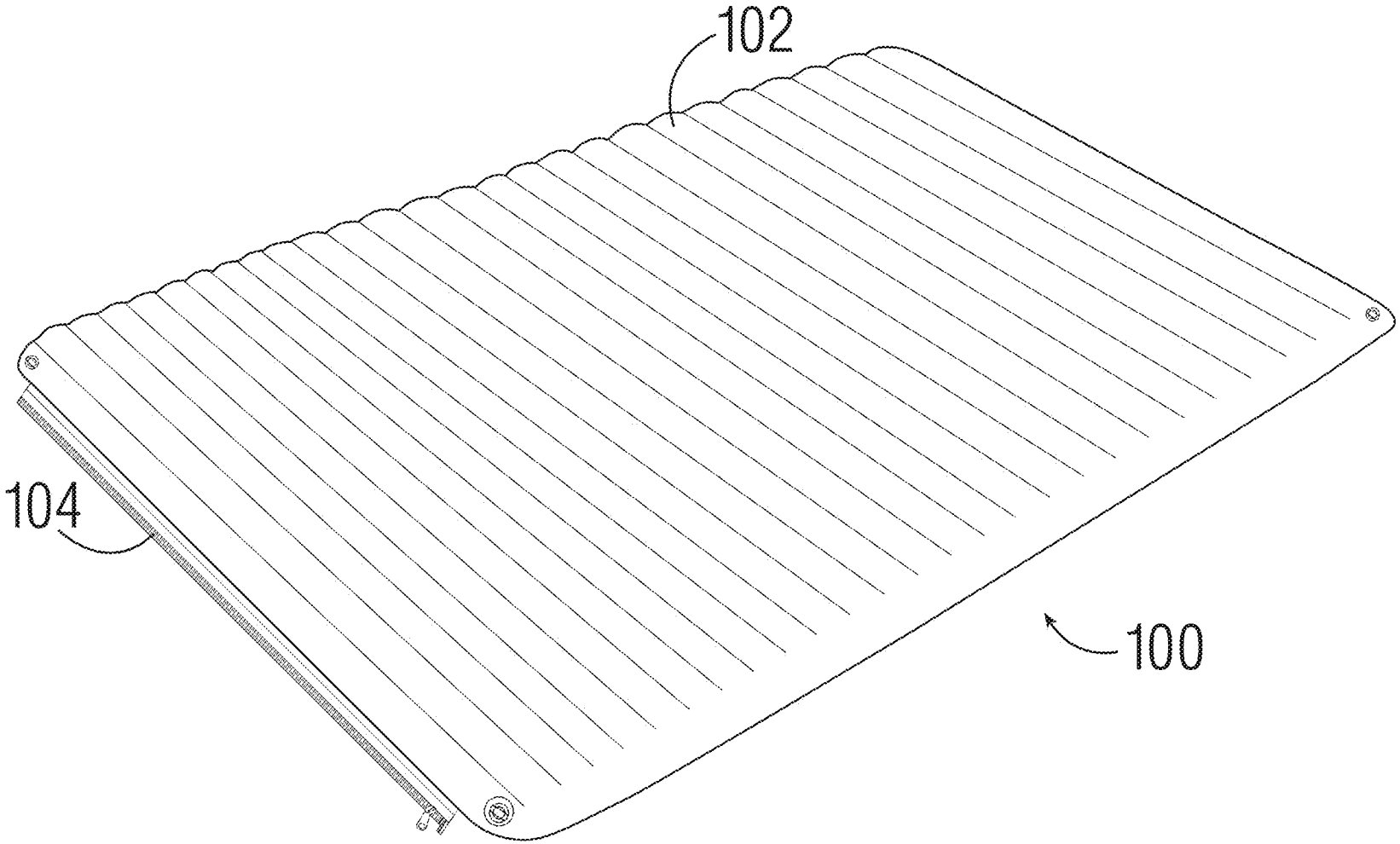
FIG. 2 is an isometric view of the inflatable mat depicted in FIG. 1.

Reference will now be made in detail to the subject matter disclosed, which is illustrated in the accompanying drawings.

The present disclosure is directed to an inflatable device that may be suitable for various aquatic activities. One or more interconnected airtight inflatable mats may be utilized to provide a floatation device capable of supporting multiple individuals in lying, sitting or standing positions. Multiple inflatable mats may also be interconnected and utilized for creating a water walkway or a floating platform of any desirable length/width. Such devices may be useful for providing a walkway to a boat, connecting multiple boats, or creating a floating platform that may be used for various purposes (e.g., relaxation, fishing or the like).

Referring generally to FIGS. 1 through 5, an apparatus 100 including an airtight inflatable mat 102 having a pair of fastening mechanisms 104 is shown. In one embodiment, the inflatable mat 102 is configured in a generally rectangular configuration. When inflated, the inflatable mat 102 defines a top surface 106 (may also be referred to as the first surface member), a bottom surface 108 (may also be referred to as the second surface member), two elongated sides 110 and two short sides 112. It is understood that the inflatable mat 102 may be made of various types of flexible materials such as plastics or the like. The inflatable mat 102 may be formed using one or more fabricated pieces joined together. The specific material and process utilized for producing the inflatable mat 102 may vary without departing from the spirit and scope of the present disclosure. In addition, due to the nature of the mat being inflatable, it is contemplated that certain corners/edges/sides may be rounded or curved when inflated.

Figure 3:
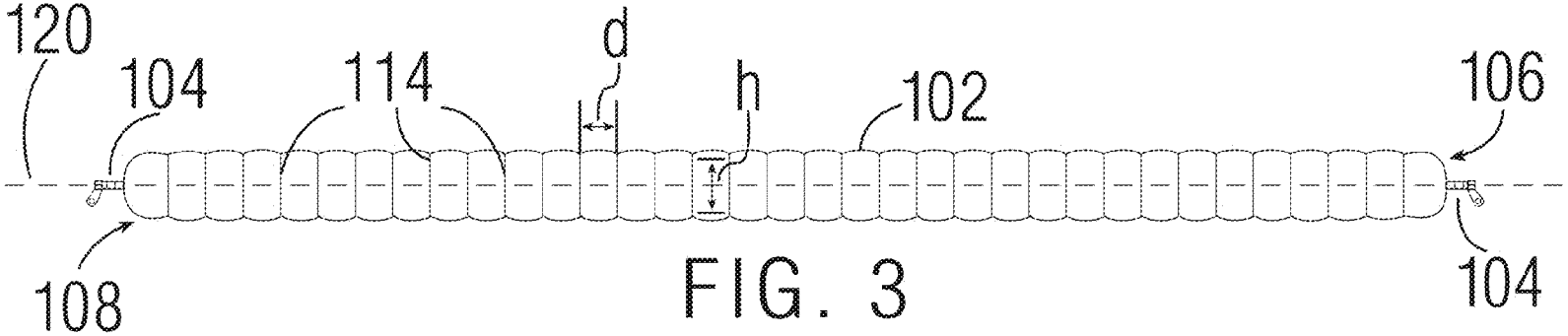
FIG. 3 is a cross-sectional side view of the inflatable mat depicted in FIG. 1.

A plurality of support structures 114 is disposed internally within the inflatable mat 102. As shown in FIG. 3, the support structures 114 may be configured as longitudinally disposed vertical beams (may be referred to as I-beams) which are coupled (e.g., heat welded or otherwise joined together) to the top and bottom (with respect to the orientation depicted in FIG. 3) of the inflatable mat 102. The support structures 114 serve as retention members and function to limit the outward expansion of the top and bottom surfaces of the inflatable mat 102.

In one embodiment, the support structures 114 are configured to be generally parallel to the two short sides 112 of the inflatable mat 102 (and are therefore generally parallel relative to each other). In addition, the support structures 114 are disposed substantially evenly in between the two short sides 112. The distance d between two adjacent support structures 114 may be between approximately 1 and 3 inches. Furthermore, the height h of the support structures 114 may be between approximately 4 and 6 inches. Such a configuration allows the inflatable mat 102 to provide sufficient support for individual(s) using the inflatable mat 102, even when the individual(s) is in standing position and/or walking.

In one particular implementation, when inflated, the length of the inflatable mat 102 may be approximately 10 feet, the width of the inflatable mat 102 may be approximately 6 feet, and the height of the inflatable mat 102 (and the height h of the support structures) may be approximately 5 inches. The distance d between two adjacent support structures 114 may be approximately 2 inches for this particular implementation. However, it is contemplated that the specific dimensions described above are merely exemplary. The inflatable mat 102 may vary in size without departing from the spirit and scope of the present disclosure.

Figure 4:
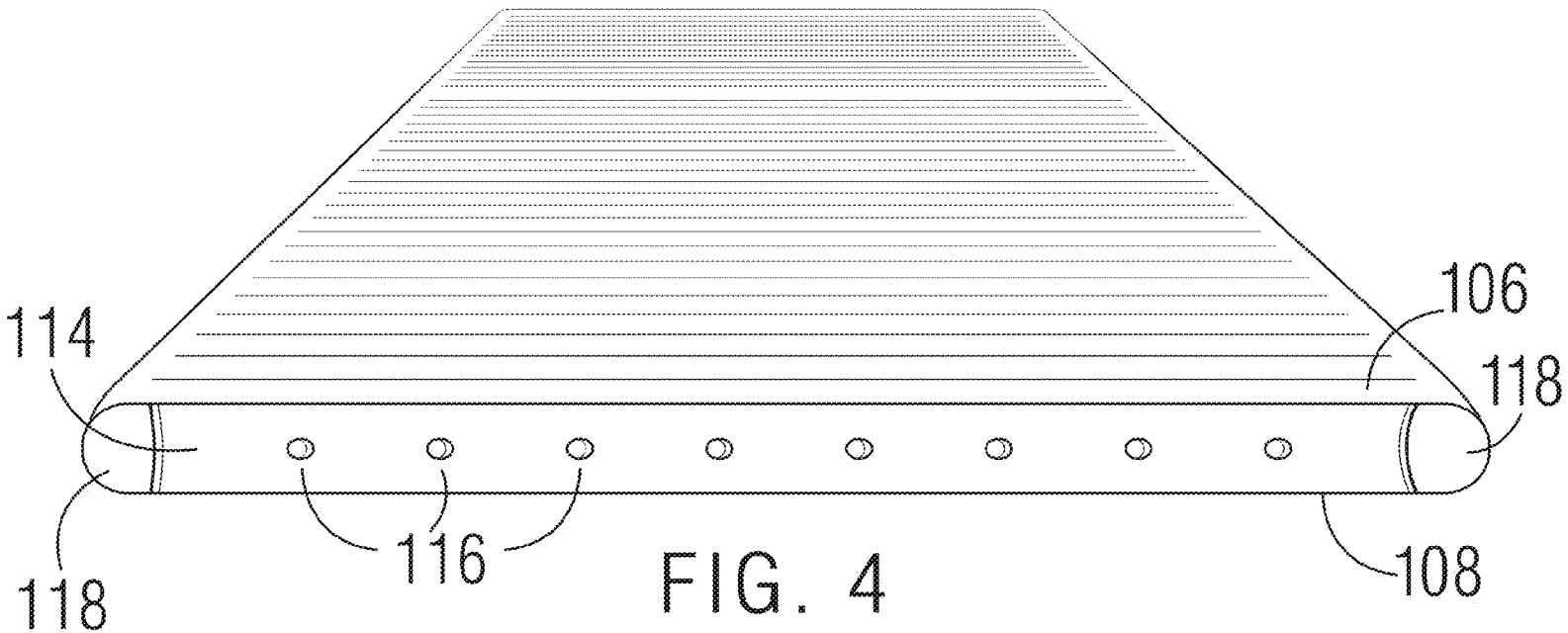
FIG. 4 is an illustration depicting an internal support structure within the inflatable mat.

It is contemplated that each support structure 114 may include a plurality of air passages to allow air flow within the inflatable mat 102. For example, as illustrated in FIG. 4, each support structure 114 may define multiple perforations/apertures 116 to allow air flow within the inflatable mat 102. Additionally and/or alternatively, a space 118 may be defined at each end of the support structure 114 so that air can work around the support structure 114. It is also contemplated that while the support structures 114 described above are configured as vertical beams (or I-beams), such a configuration is merely exemplary. Other types of support structures such as wave beams, X-beams or the like may also be utilized.

Figure 5:
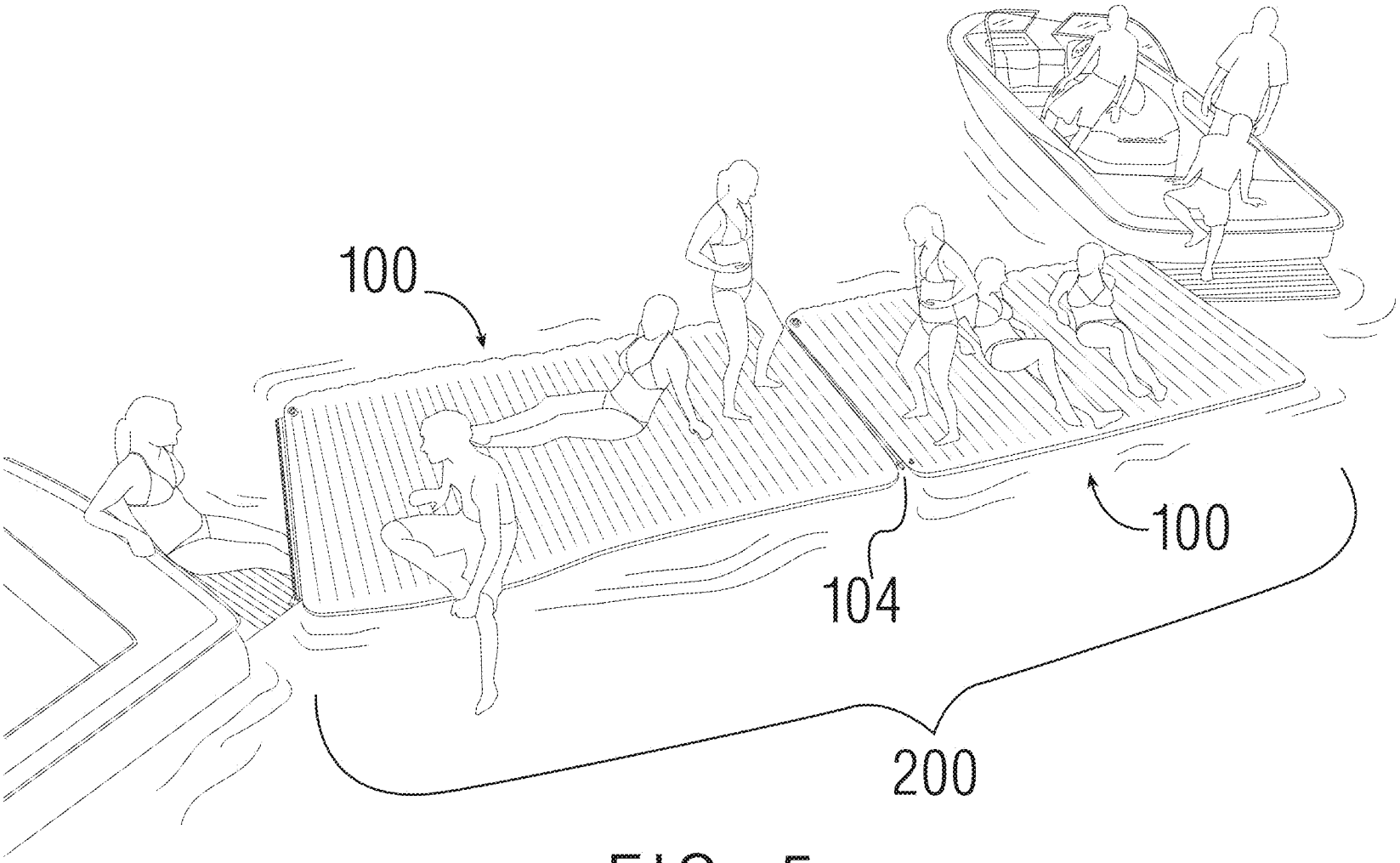
FIG. 5 is an illustration depicting a water walkway provided utilizing the inflatable mats in accordance with the present disclosure.
Figure 6:
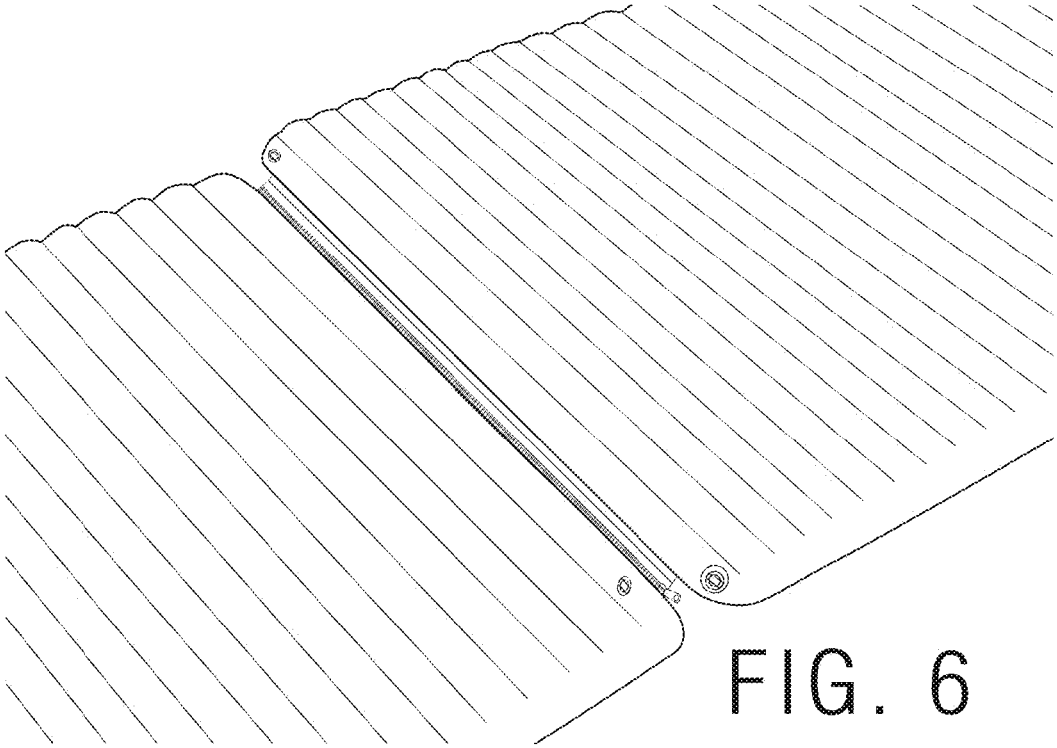
FIGS. 6-12 are partial isometric views illustrating various types of fastening mechanisms utilized for interconnecting two inflatable mats.

The apparatus 100 in accordance with the present disclosure further includes at least one pair of fastening mechanisms 104. The fastening mechanisms 104 are respectively disposed on the two short sides 112 of the inflatable mat 102. Each fastening mechanism 104 is configured for removably connecting with another fastening mechanism disposed on the short side of another airtight inflatable mat, allowing the user to interconnect two or more of such inflatable mats to form a walkway of a desired length. For example, a water walkway 200 formed utilizing two inflatable mats in accordance with the present disclosure is depicted in FIG. 5.

In one embodiment, the fastening mechanism 104 is configured to extend along a majority of the full lengths of the short side 112 of which the fastening mechanism 104 is coupled to (e.g., extending along at least 80% of the side 112). In addition, the fastening mechanism 104 is positioned on a plane 120 that is centrally located between the top and the bottom of the inflatable mat 102. Such a configuration strengthens the regions around the interconnected fastening mechanisms and provides adequate support for users even when they stand or walk around these regions.

Figure 7:
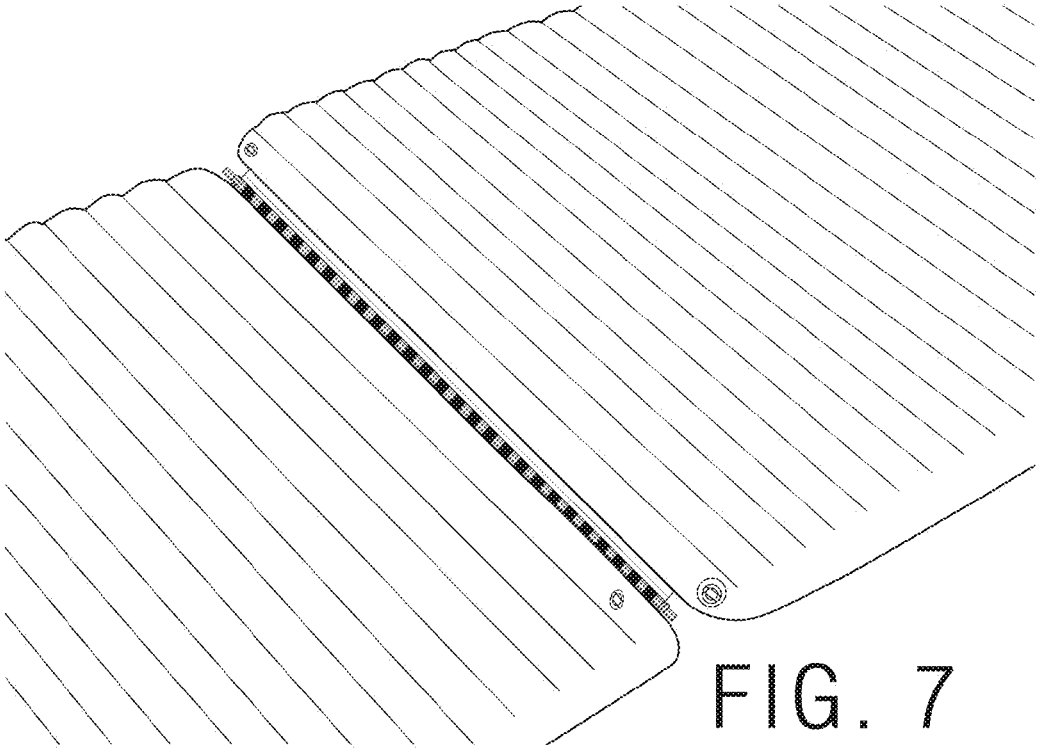
Figure 8:
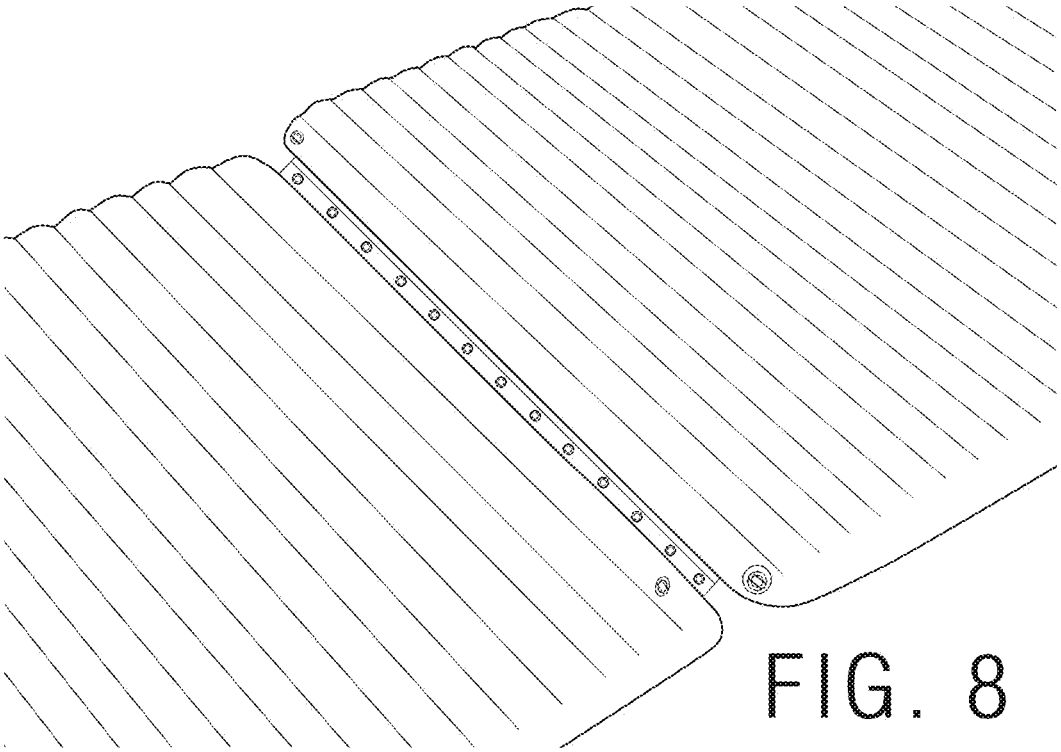
Figure 9:
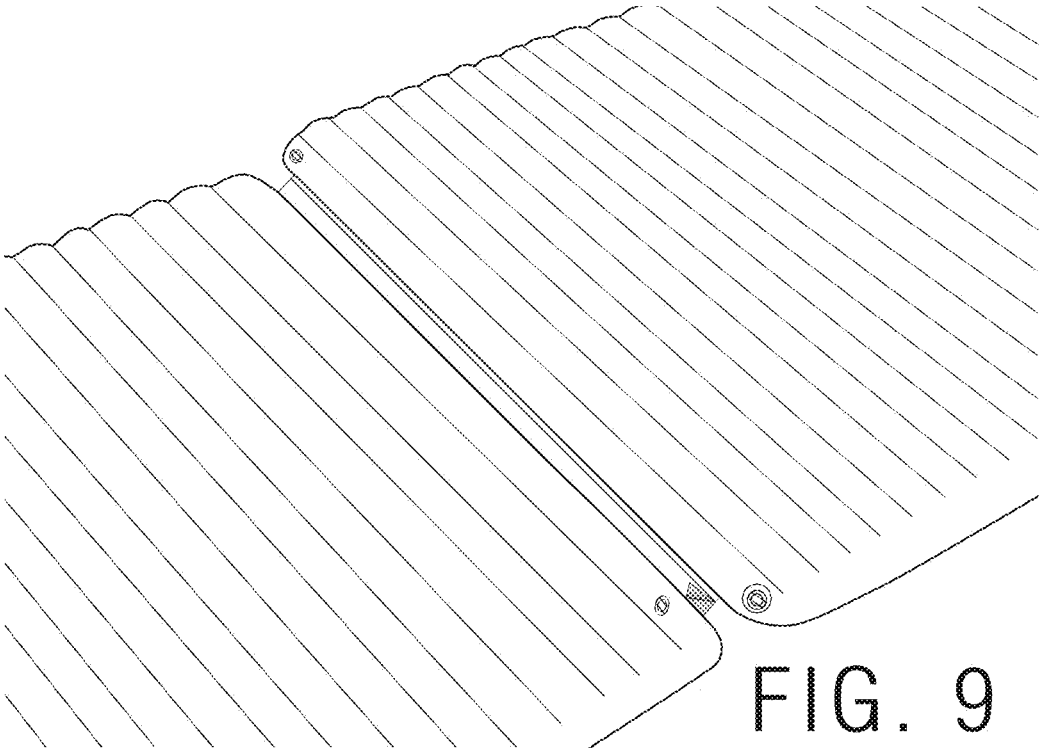
Figure 10:
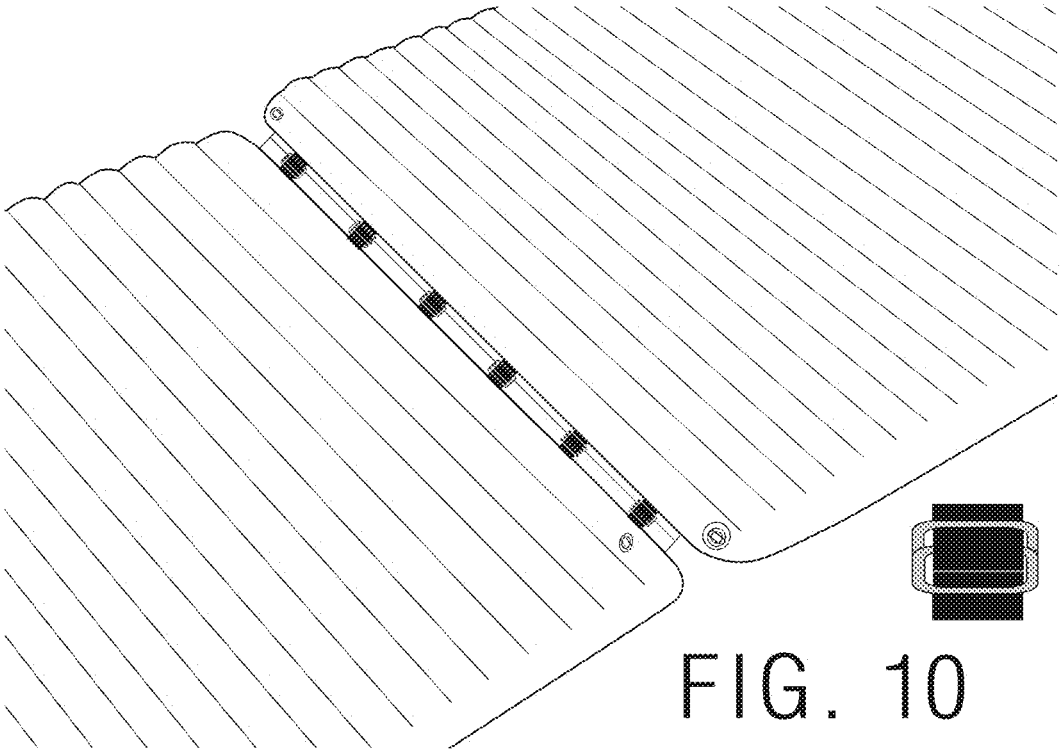
Figure 11:
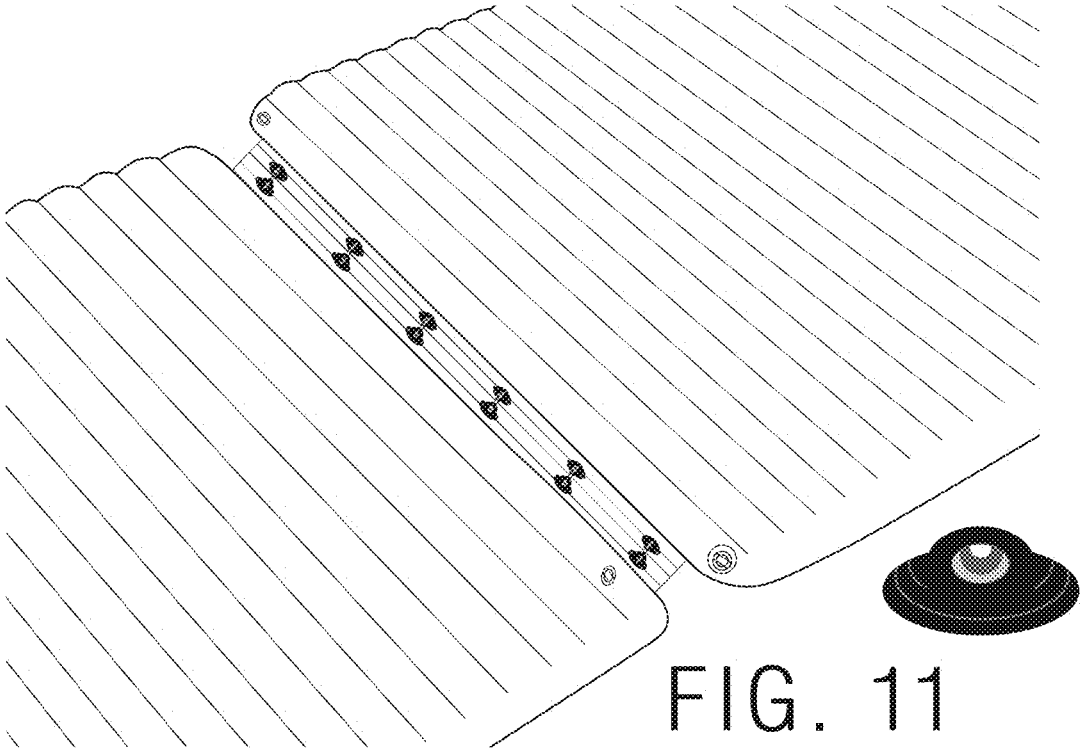
Figure 12:
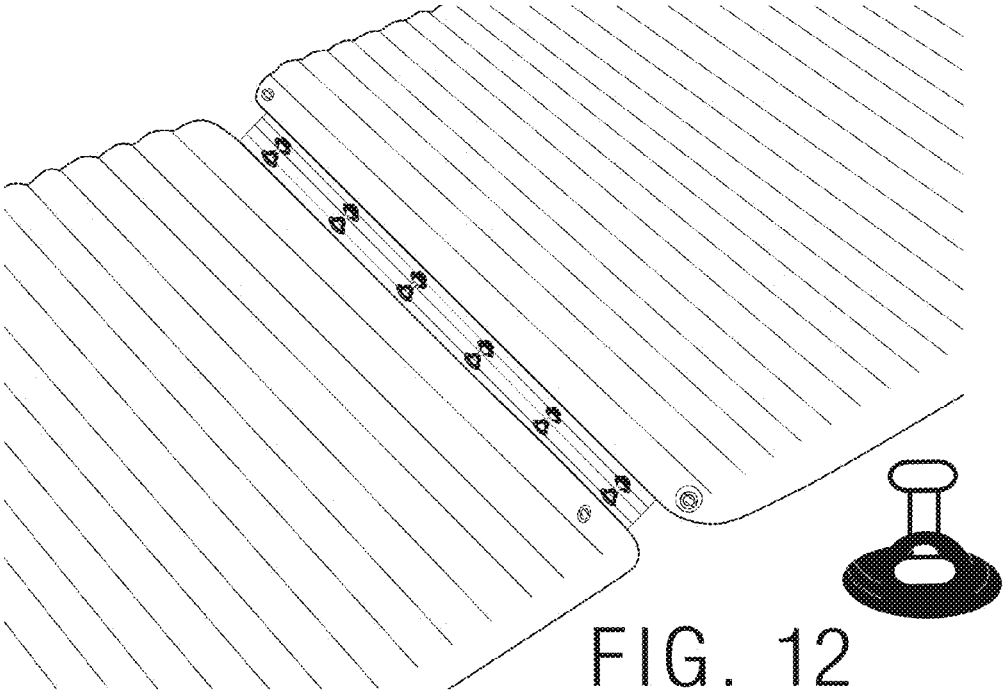

It is contemplated that various types of fastening mechanisms may be utilized for interconnecting the inflatable mats, as illustrated in FIGS. 6 through 12. For instance, zippers may be utilized as the fastening mechanisms 104 as shown in the FIG. 6. However, other types of fastening mechanisms may also be utilized. Exemplary fastening mechanisms may include, but not limited to, the looped connection system as shown in FIG. 7, the snapped connection system as shown in FIG. 8, the hook and loop fastener connection system as shown in FIG. 9, the buckled connection system as shown in FIG. 10, the grommet with rope connection system as shown in FIG. 11, the grommet connection system as shown in FIG. 12, as well as other types of fastening mechanisms without departing from the spirit and scope of the present disclosure.

Figure 13:
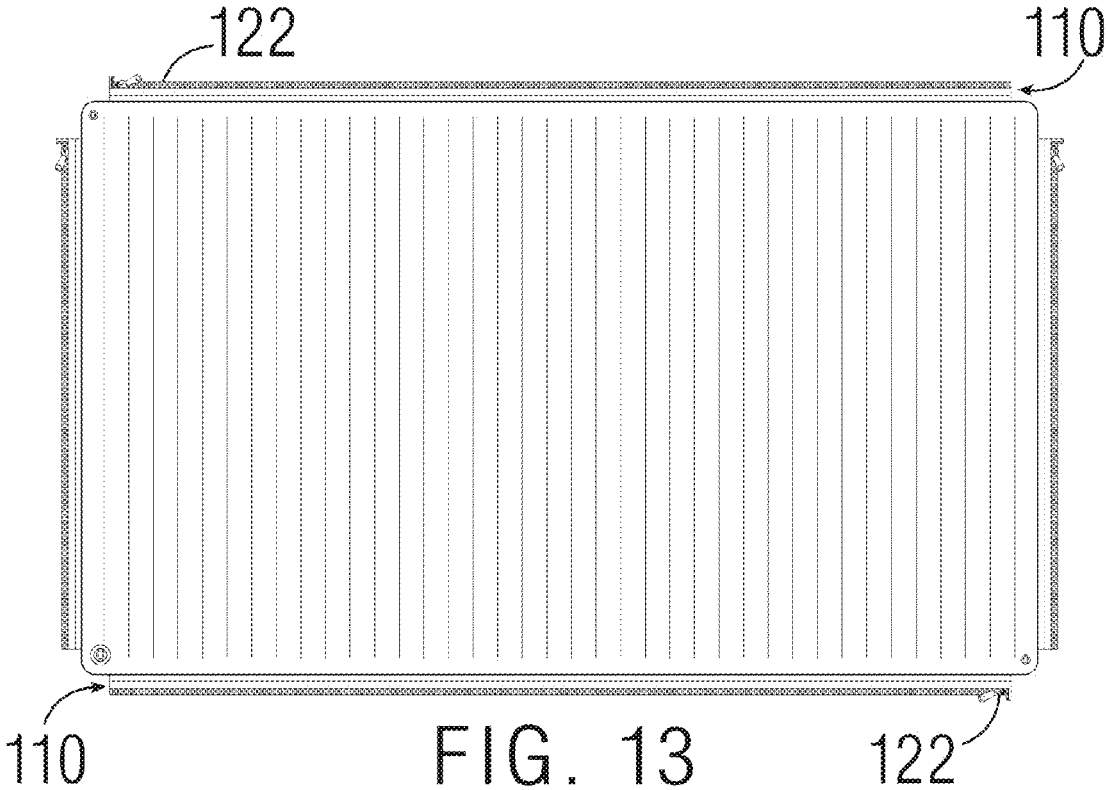
FIG. 13 is a top view of an inflatable mat having two pairs of fastening mechanisms.

It is also contemplated that additional fastening mechanisms 122 may be disposed on the elongated sides 110, as illustrated in FIG. 13. This would allow the user to interconnect two or more inflatable mats along the elongated sides in addition or instead of the short sides. In this manner, the user may form a walkway or a platform of a desired length and/or width. It is contemplated that the fastening mechanisms disposed on the elongated sides may or may not be the same as the fastening mechanisms disposed on the short sides.

While the exemplary embodiment above describes a water walkway/platform formed utilizing generally rectangular inflatable mats, it is contemplated that the inflatable mats are not limited to a certain geometrical shape/configuration. That is, an inflatable mat in accordance with the present disclosure may be of any geometrical shape/configuration as long as it includes a plurality of internally disposed support structures for providing sufficient support for individual(s) using the inflatable mat, and fastening mechanisms for providing interconnectivity with other inflatable mats (as previously described).

Figure 14:
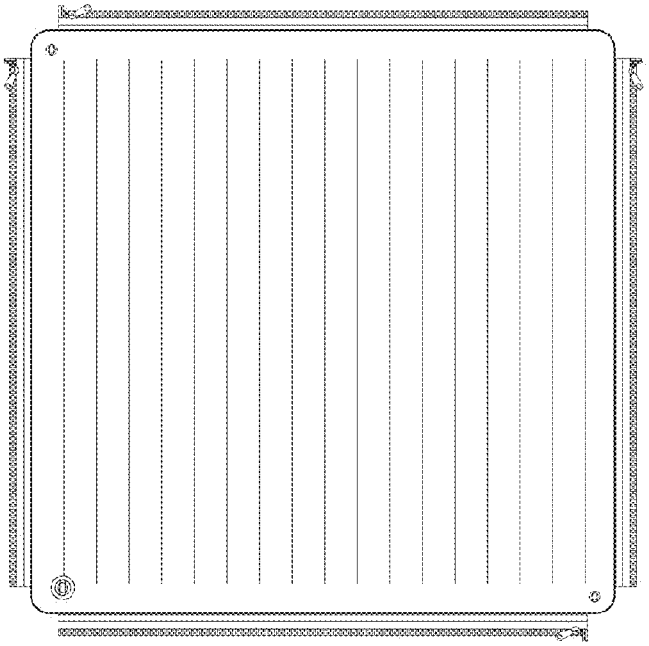
FIGS. 14-26 are top views illustrating various shapes of inflatable mats in accordance with the present disclosure.
Figure 15:
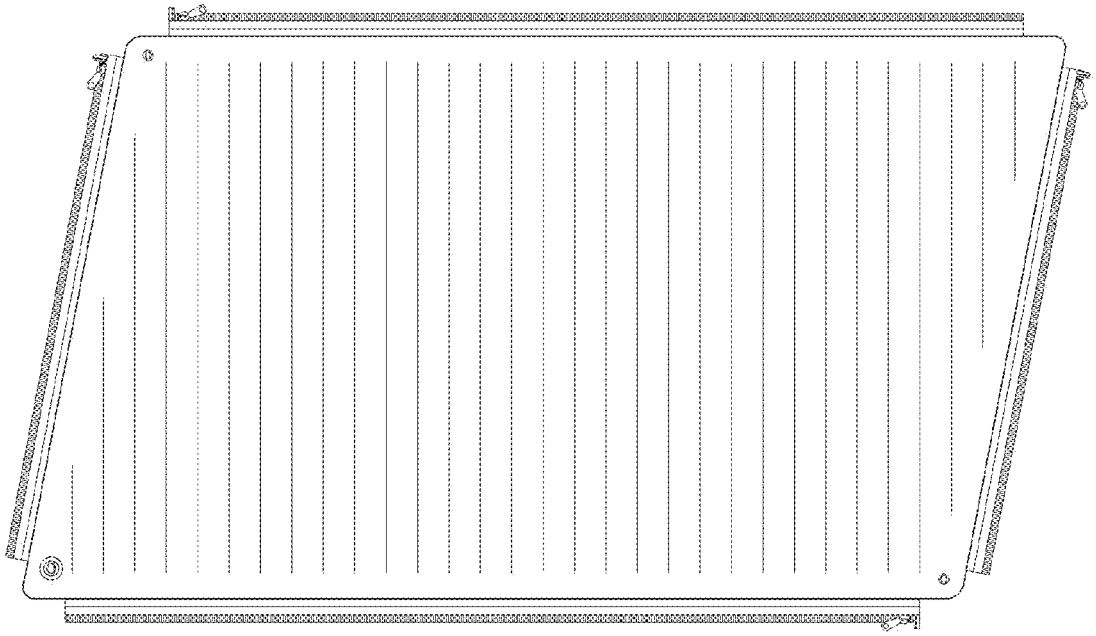
Figure 16:
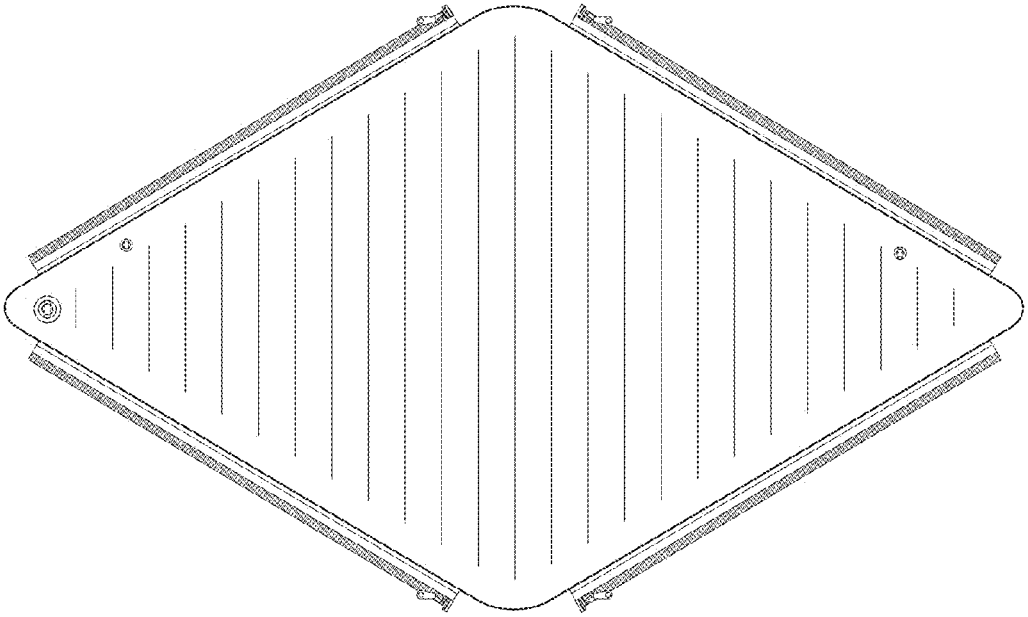
Figure 17:
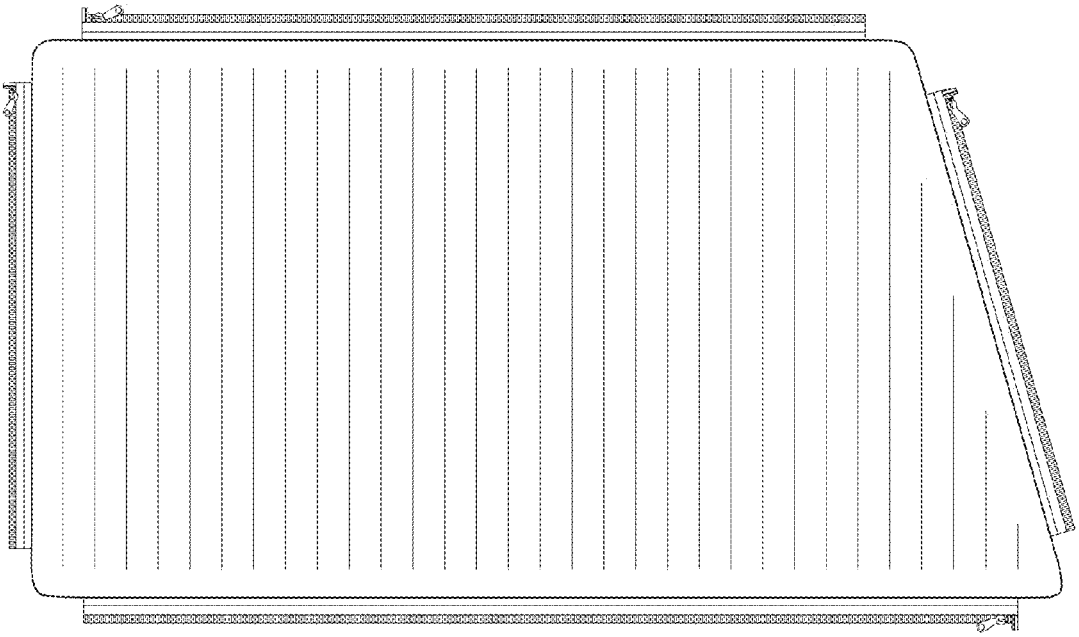
Figure 18:
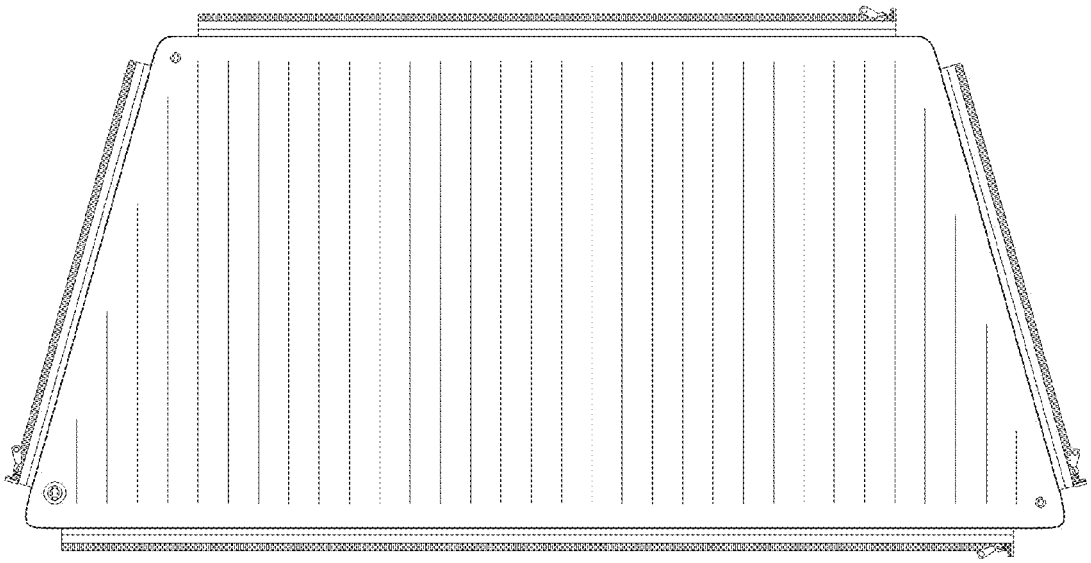
Figure 19:
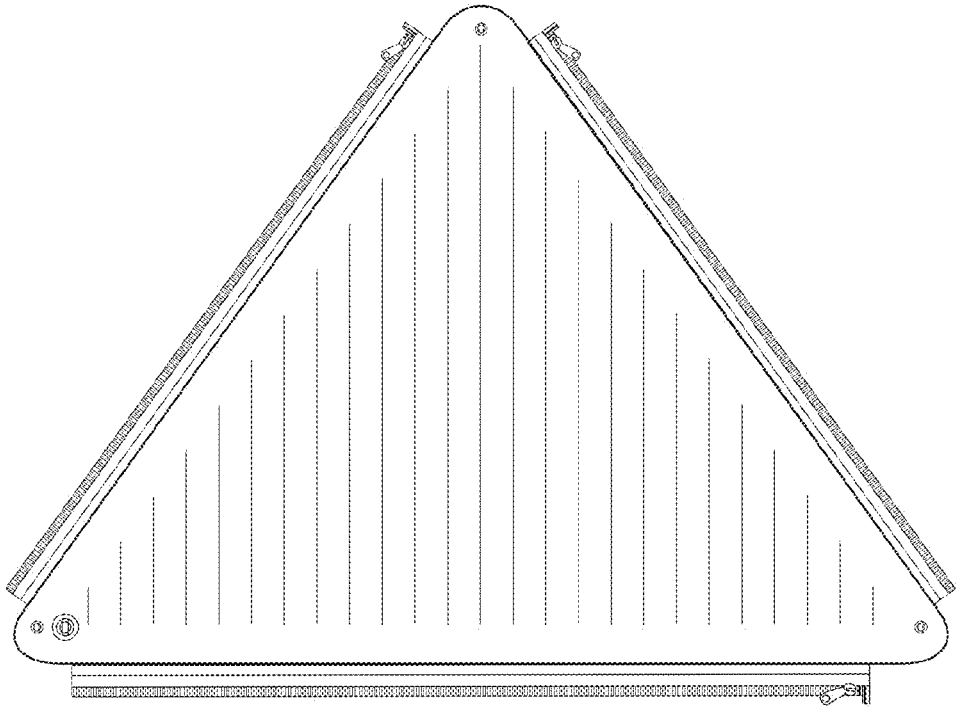
Figure 20:
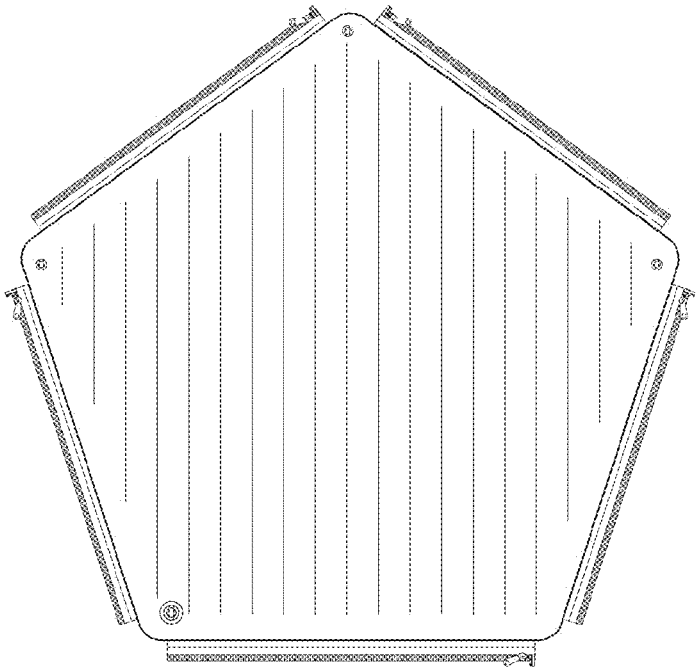
Figure 21:
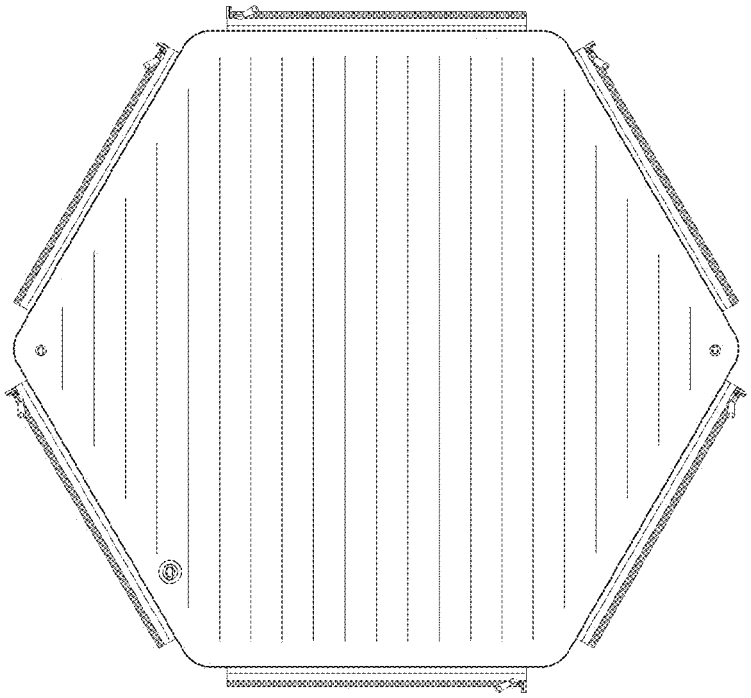
Figure 22:
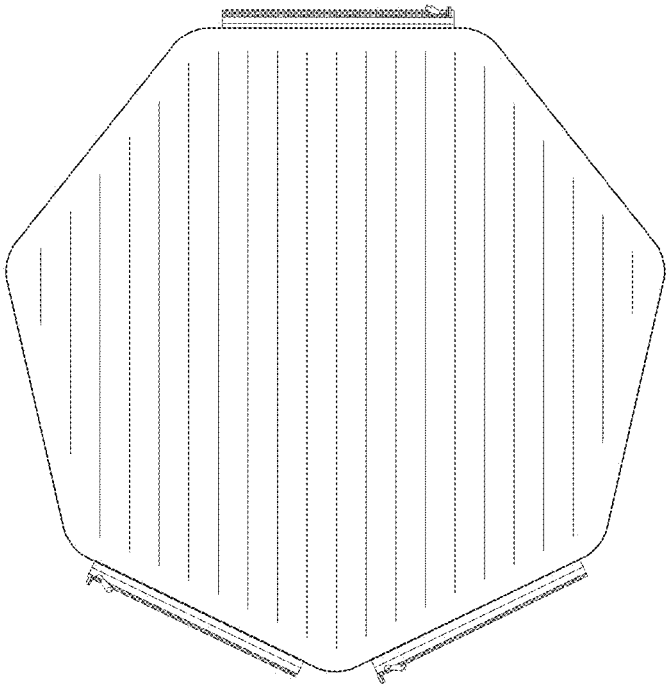
Figure 23:
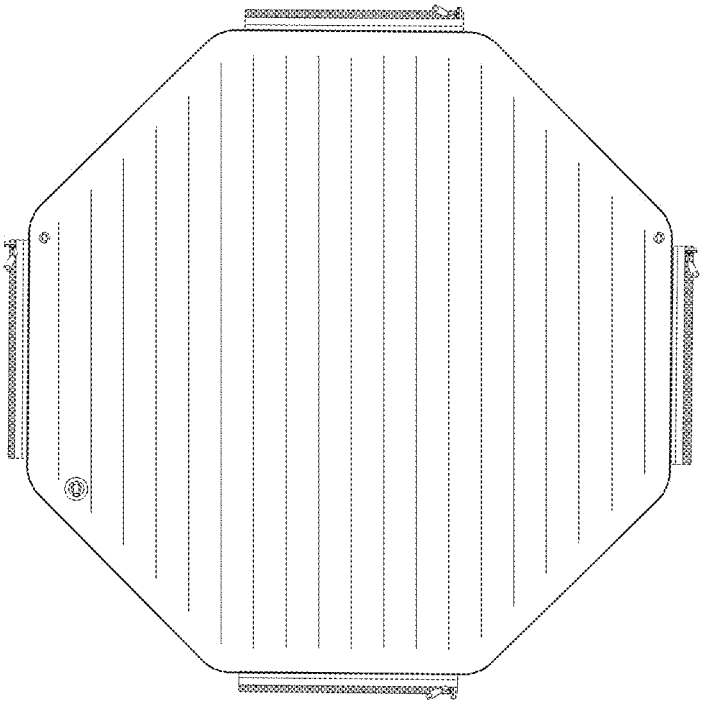
Figure 24:
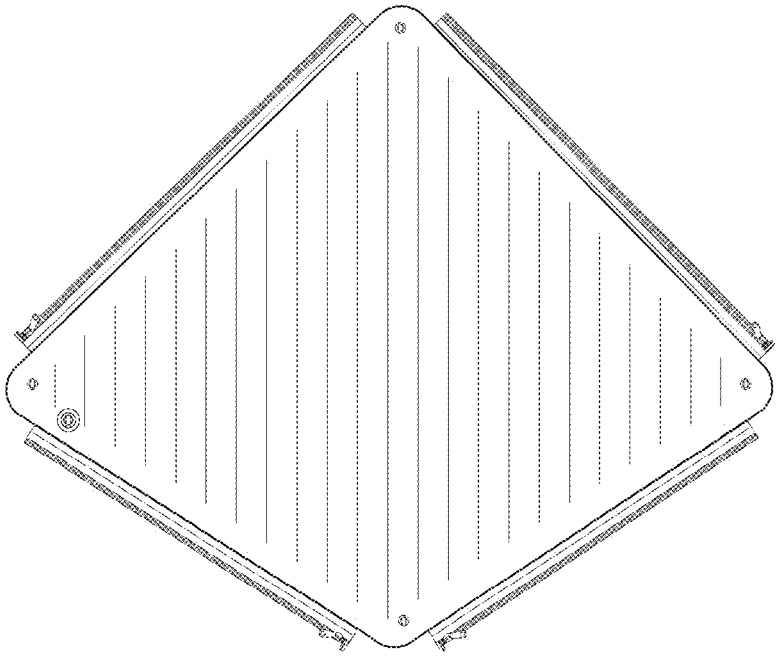
Figure 25:
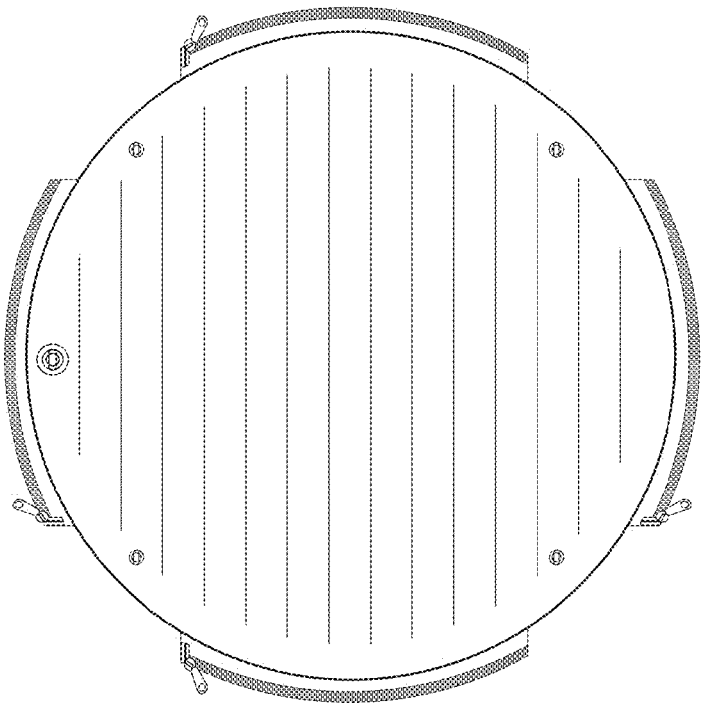
Figure 26:
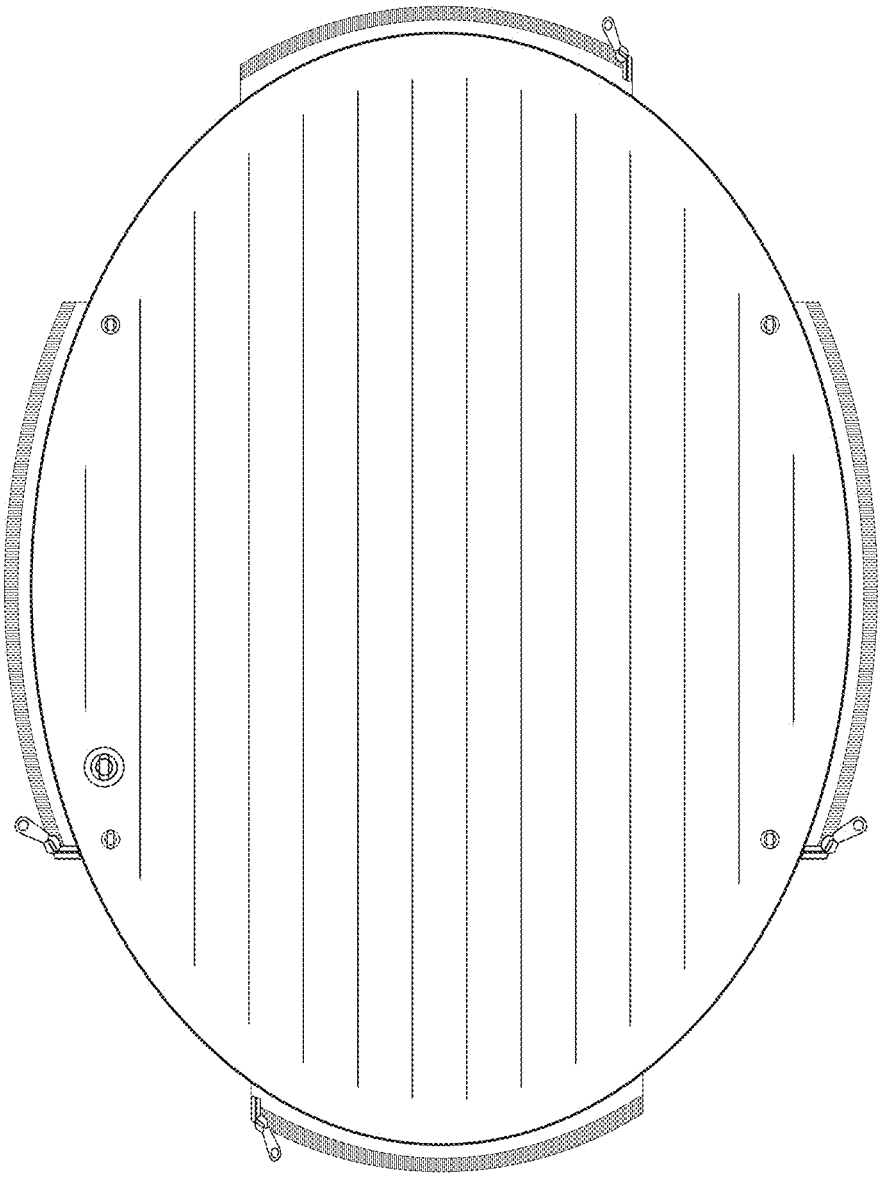

It is contemplated that some exemplary shapes may include, but not limited to, a square shape as shown in FIG. 14, a parallelogram shape as shown in FIG. 15, a rhombus shape as shown in FIG. 16, a trapezoid shape as shown in FIG. 17, an isosceles shape as shown in FIG. 18, a triangular shape as shown in FIG. 19, as well as various other polygonal shapes as shown in FIGS. 20 though 24. It is also contemplated that the fastening mechanisms utilized for providing interconnectivity between inflatable mats are not required to be disposed on a straight side of the mat. The flexible nature of the fastening mechanisms as well as the relatively large scale inflatable mat (e.g., 5 ft in diameter or more) allows the fastening mechanisms to be disposed on a curved side and still be able to provide interconnectivity with other inflatable mats. Therefore, the inflatable mats may be configured in a circular or oval shape, as shown in FIGS. 25 and 26, respectively.

Figure 27:
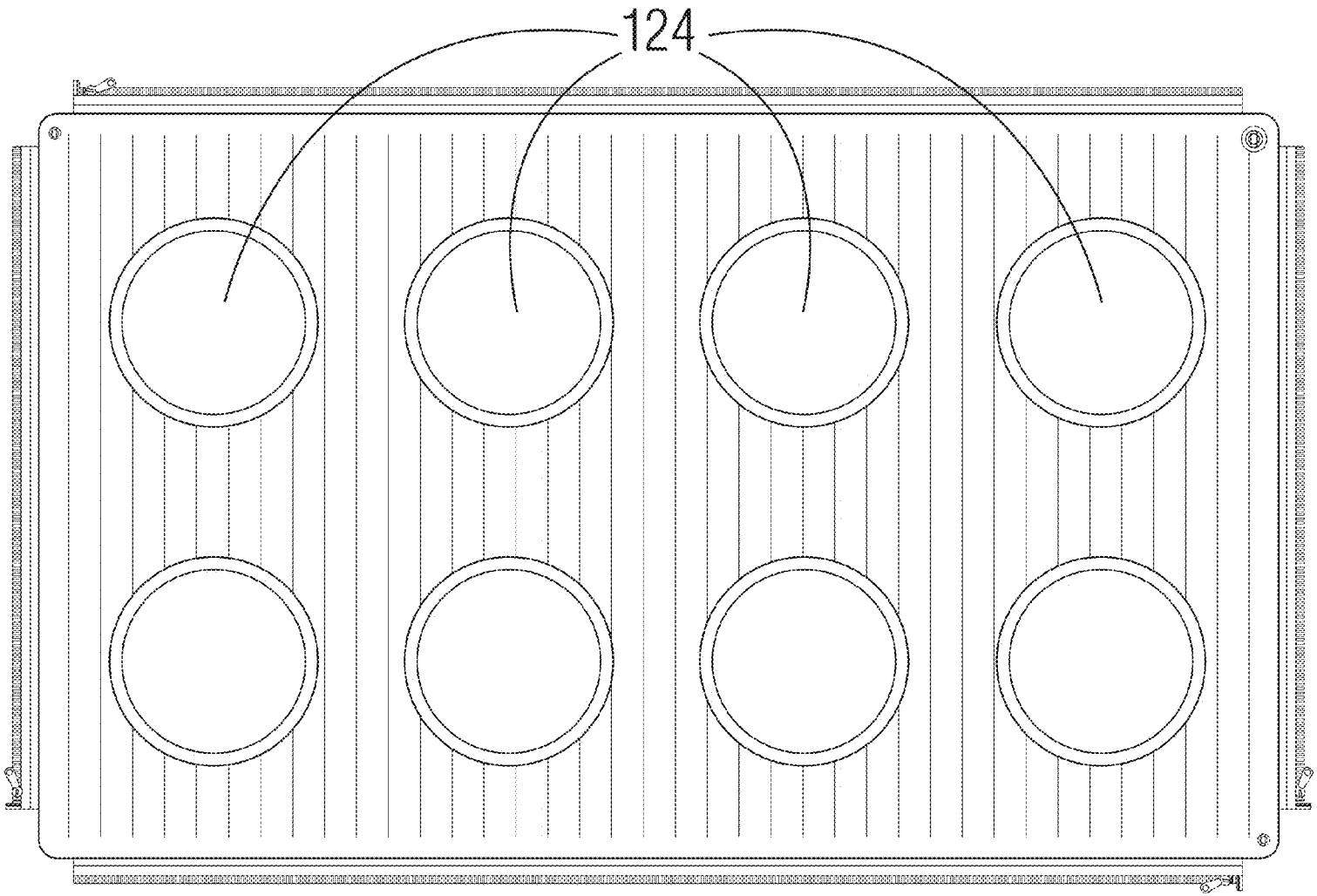
FIG. 27 is a top view of an inflatable mat having a plurality of openings defined thereof.

It is further contemplated that the inflatable mat in accordance with the present disclosure may define one or more openings 124 suitable for sitting or lounging, as illustrated in FIG. 27. For example, the opening 124 may allow a user to extend his/her legs through, therefore providing a more comfortable sitting position for the user. Such openings 124 also allow the users to sit face to face, which may be appreciated for various purposes such as game playing, carrying out conversations or the like. It is understood that while the openings 124 as illustrated in FIG. 27 are configured to be circular, other shapes/configurations may be also be utilized. In addition, the positions of the openings 124 may be arranged differently than depicted in FIG. 27 without departing from the spirit and scope of the present disclosure.

The apparatus in accordance with the present disclosure provides a convenient way for creating a water walkway or a floating platform. The inflatable mats are configured to support multiple individuals in lying, sitting or standing positions. The fastening mechanisms allow the users to interconnect multiple mats to form a walkway/platform of any desirable length/width. Furthermore, when deflated, the mats may be folded or rolled-up, and therefore compact and easy to carry around.

It is understood that the present disclosure is not limited to any underlying implementing technology. The present disclosure may be implemented using a variety of technologies without departing from the scope and spirit of the invention or without sacrificing all of its material advantages.

It is believed that the present disclosure and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An apparatus, comprising:

a generally rectangular airtight inflatable mat, the airtight inflatable mat having a first surface member, a second surface member, two elongated sides and two short sides;

a plurality of support structures disposed internally within the airtight inflatable mat, each of the plurality of support structures being generally parallel to the two short sides and being coupled to the first surface member and the second surface member of the airtight inflatable mat, each of the plurality of support structures including a longitudinally disposed vertical beam having a plurality of apertures defined substantially evenly along a longitudinal axis of the longitudinally disposed vertical beam, a height of each longitudinally disposed vertical beam being between approximately 4 and 6 inches, the plurality of support structures being disposed substantially evenly in between the two short sides of the airtight inflatable mat, and a distance between two adjacent support structures being between approximately 1 and 3 inches; and a pair of fastening mechanisms respectively disposed on the two short sides of the airtight inflatable mat, the pair of fastening mechanisms being positioned on a plane substantially centrally located between the first surface member and the second surface member, each of the pair of fastening mechanisms extending along a majority of the full length of the corresponding short side of the airtight inflatable mat, and each of the pair of fastening mechanisms configured for removably connecting with another fastening mechanism disposed on a short side of another airtight inflatable mat.

2. The apparatus of claim 1, wherein each fastening mechanism includes at least one of: a zipper fastening mechanism, a loop connection fastening mechanism, a snap connection fastening mechanism, a hook and loop fastener connection fastening mechanism, a buckled connection fastening mechanism, a grommet with rope connection fastening mechanism, or a grommet fastening mechanism.

3. The apparatus of claim 1, further comprising:

a second pair of fastening mechanisms respectively disposed on the two elongated sides of the airtight inflatable mat, the second pair of fastening mechanisms being positioned on a plane substantially centrally located between the first surface member and the second surface member, and each of the second pair of fastening mechanisms configured for removably connecting with another fastening mechanism disposed on an elongated side of another airtight inflatable mat.

4. The apparatus of claim 1, wherein the generally rectangular airtight inflatable mat is approximately 10 feet long, approximately 6 feet wide and approximately 5 inches thick.

5. The apparatus of claim 4, wherein the distance between two adjacent support structures is approximately 2 inches.

6. An apparatus, comprising:

an airtight inflatable mat, the airtight inflatable mat having a first surface member, a second surface member and at least one side member;

a plurality of support structures substantially evenly disposed internally within the airtight inflatable mat, each of the plurality of support structures being generally parallel to each other and being coupled to the first surface member and the second surface member of the airtight inflatable mat, each of the plurality of support structures including a longitudinally disposed vertical beam having a plurality of apertures defined substantially evenly along a longitudinal axis of the longitudinally disposed vertical beam, a height of each longitudinally disposed vertical beam being between approximately 4 and 6 inches, and a distance between two adjacent support structures being between approximately 1 and 3 inches; and a plurality of zipper fastening mechanisms disposed on the at least one side member of the airtight inflatable mat, the plurality of zipper fastening mechanisms being positioned on a plane substantially centrally located between the first surface member and the second surface member, each of the plurality of zipper fastening mechanisms extending along a majority of the full length of the corresponding side member of the airtight inflatable mat, and each of the plurality of zipper fastening mechanisms configured for removably connecting with another fastening mechanism disposed on a side member of another airtight inflatable mat.

7. An apparatus, comprising:

a first airtight inflatable mat, the first airtight inflatable mat having a first surface member, a second surface member and at least one side member;

a second airtight inflatable mat identical to the first airtight inflatable mat, the second airtight inflatable mat having a first surface member, a second surface member and at least one side member;

a plurality of support structures substantially evenly disposed internally within each of the first and second airtight inflatable mat, the support structures being generally parallel to each other and being coupled to the first surface member and the second surface member of their respective airtight inflatable mat, each of the plurality of support structures including a longitudinally disposed vertical beam having a plurality of apertures defined substantially evenly along a longitudinal axis of the longitudinally disposed vertical beam, a height of each longitudinally disposed vertical beam being between approximately 4 and 6 inches, and a distance between two adjacent support structures being between approximately 1 and 3 inches; and a pair of fastening mechanisms respectively disposed on the at least one side member of the first and second airtight inflatable mat, the pair of fastening mechanisms configured for removably connecting the first and second airtight inflatable mat to form a floatable walkway, wherein the fastening mechanism disposed on each of the first and second airtight inflatable mat is positioned on a plane substantially centrally located between the first surface member and the second surface member of their respective airtight inflatable mat, wherein the first surface members of the first airtight inflatable mat and the second airtight inflatable mat generally coincide on a first plane and the second surface members of the first airtight inflatable mat and the second airtight inflatable mat generally coincide on a second plane when the first and second airtight inflatable mat are connected utilizing the fastening mechanism to form the floatable walkway, and wherein the fastening mechanism disposed on each of the first and second airtight inflatable mat extends along a majority of the full length of the corresponding side member of their respective airtight inflatable mat.

8. The apparatus of claim 7, wherein the first airtight inflatable mat and the second airtight inflatable mat are generally rectangular airtight inflatable mats.

9. The apparatus of claim 7, wherein each fastening mechanism includes at least one of: a zipper fastening mechanism, a loop connection fastening mechanism, a snap connection fastening mechanism, a hook and loop fastener connection fastening mechanism, a buckled connection fastening mechanism, a grommet with rope connection fastening mechanism, or a grommet fastening mechanism.

* * * * *